US005224917A

United States Patent [19]

Kilsdonk

[11] Patent Number: 5,224,917

[45] Date of Patent: Jul. 6, 1993

[54] DIELECTRIC INSERT REPAIR TOOL

[75] Inventor: Jan A. Kilsdonk, Corona, Calif.

[73] Assignee: McDonnell Douglas Corporation, Long Beach, Calif.

[21] Appl. No.: 542,953

[22] Filed: Jun. 25, 1990

[51] Int. Cl.[5] ..... H01R 43/00

[52] U.S. Cl. ..... 29/764; 29/259

[58] Field of Search ..... 29/764, 258, 259

[56] References Cited

U.S. PATENT DOCUMENTS 1,426,835 8/1922 Mohrman ..... 29/259

1,478,648 12/1923 Grahek ..... 29/259

1,701,699 2/1929 Smith ..... 29/259 X

*Primary Examiner*—Carl E. Hall

*Attorney, Agent, or Firm*—Donald E. Stout; John P. Scholl

[57] ABSTRACT

A tool for removing the dielectric insert of a metal shell electrical connector. The tool holds the shell and has a threaded press that pushes the dielectric insert out of the shell. The tool is then used to push a new dielectric insert into the shell. The tool is adjustable, such that it can be used on various sized connectors.

5 Claims, 1 Drawing Sheet

DIELECTRIC INSERT REPAIR TOOL

BACKGROUND OF THE INVENTION

Most electrical connectors consist of a dielectric insert supported by a metallic shell. The dielectric, electrically insulates the individual leads of the connector. During the life of a connector, it is common for the dielectric to become chipped or damaged in some manner. Typically, the whole connector is replaced. It would be more economical to reuse the existing metal shell, while replacing just the dielectric insert. Therefore, what is needed is a method and tool that replaces the dielectric insert of an electrical connector.

SUMMARY OF INVENTION

This invention is a method and tool for removing the dielectric insert of a metal shell electrical connector. The tool holds the shell and has a threaded press that pushes the dielectric insert out of the shell. The tool is then used to push a new dielectric insert into the shell. The tool is adjustable, such that it can be used on various sized connectors.

Therefore, it is an object of this invention to provide a method and tool to replace the dielectric insert of a metal shell electrical connector.

It is also an object of this invention to provide a tool to replace a dielectric insert, that is adjustable to various connector sizes, inexpensive and easy to use.

BRIEF DESCRIPTION OF THE DRAWINGS

The objectives and advantages of this invention will become more apparent to those skilled in the art, after reviewing the following specification and drawings, wherein.

DETAILED DESCRIPTION OF THE INVENTION

Figure 1:
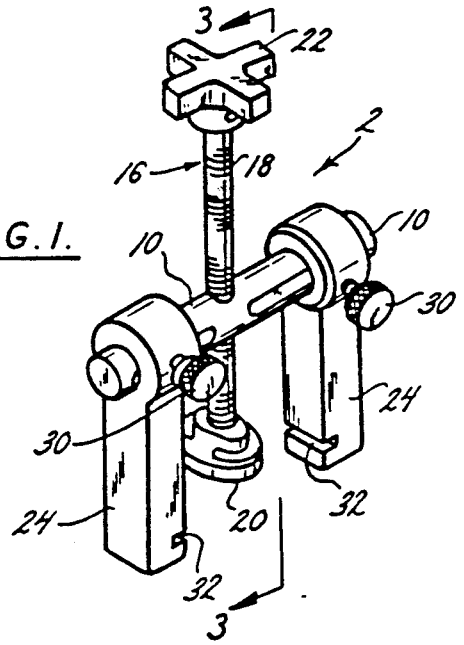
FIG. 1 is a perspective view of a dielectric insert repair tool.
Figure 2:
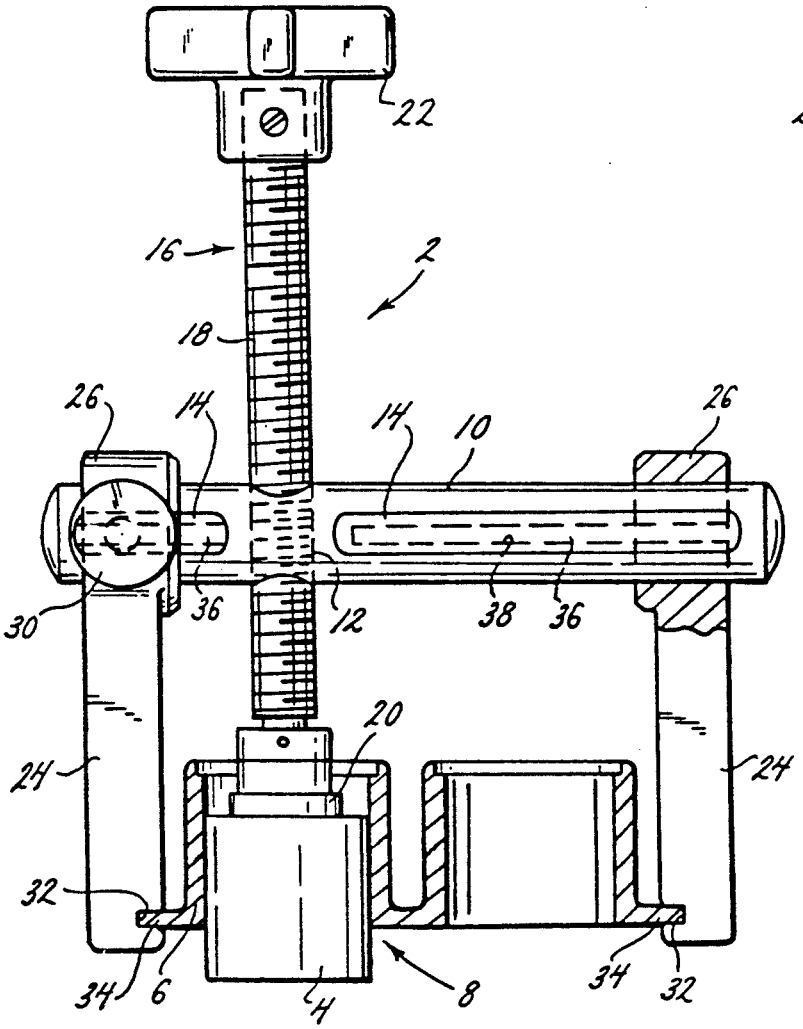
FIG. 2 is a side view of a dielectric insert repair tool.
Figure 3:
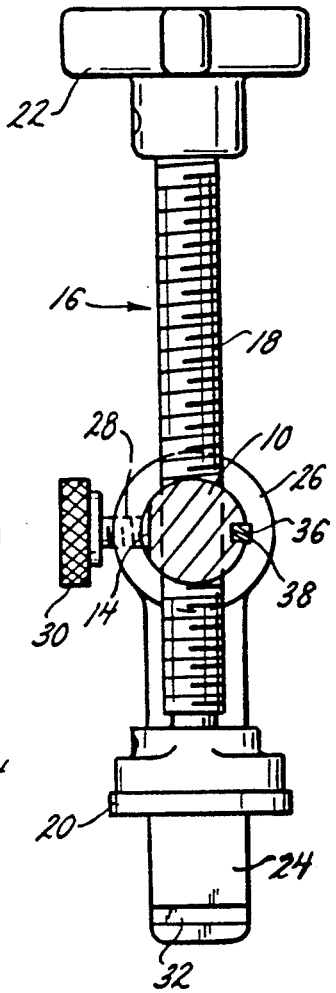
FIG. 3 is a cross sectional view of a dielectric insert repair tool taken at line 3-3 of FIG. 1.

Referring to the drawings more particularly by reference numbers, number 2 in FIGS. 1, 2 and 3 is a tool 2 for replacing a dielectric insert 4 in the metal shell 6 of an electrical connector 8. The tool 2 comprises a first rod 10 having a first threaded aperture 12 and a pair of faced surfaces 14. Extending through the first threaded aperture 12 is a second rod 16, with an externally threaded shank 18 that screws into the rod 10. At one end of the second rod 16 is a pad 20 that engages the dielectric insert 4. The pad 20 is attached to the shank 18 in such a manner that the shank 18 is allowed to rotate in the direction indicated by the arrow, when the pad 20 is pressed against the dielectric 4. The other end of the second rod 16 may have a handle 22, of such size and shape to allow a human hand to grasp and rotate the second rod 16. The second rod 16 could also be adapted for use with a power tool to rotate the rod 16.

The tool 2 has a pair of arms 24 that hold the shell 6. The arms 24 can have collars 26 on one end, that fit around the first rod 10, see FIG. 3. Each collar 26 has a second threaded aperture 28. Extending through the second apertures 28 are set screws 30 that engage the faced surfaces 14. The arms 24 are attached to the first rod 10, by rotating the set screws 30 until they press against the faced surfaces 14. Disengaging a screw 30 from a faced surface 14, allows an arm 24 to slide along and become attached at various points of the first rod 10. This allows the tool 2 to be used on various sized connectors 8. At the other end of the arms 24 are grooves 32 that fit onto flanges 34 extending from the connector 8, allowing the arms 24 to hold onto the shell 6. The arms 24 may be constructed such that the height of the grooves 32 are variable, allowing the arms 24 to hold flanges 34 of varying thickness. The collars 26 may have a key 36 that rides within a second groove 38 in the first rod 10, see FIG. 3. The key 36 prevents the arm 26 from rotating about the first rod 10.

As shown in FIG. 2, the tool 2 is used by holding the shell 6 with the arms 24, rotating the second rod 18 until the pad 20 engages and pushes the dielectric insert 4 out of the shell 6. A new dielectric insert (not shown) can then be pushed into the shell 4 using the same method.

While certain exemplary embodiments have been described above and shown in the accompanying drawings, it is to be understood that such embodiments are merely illustrative of, and not restrictive on, the broad invention. The invention is not to be limited by the specific constructions or arrangements shown and described, since various other modifications may occur to persons having ordinary skill in the art.

What is claimed is:

1. A tool for repairing a dielectric insert within a shell of an electrical connector, comprising:

a first rod having a first threaded aperture;

at least two arms attached to said first rod, each said arm having a groove therein into which an end of said electrical connector shell may be inserted for holding said connector shell in place; and a second rod extending through said first threaded aperture, said second rod having an externally threaded portion engaging said first threaded aperture, and being adapted to exert a force on said dielectric insert when screwed downwardly through said first threaded aperture, thereby pushing the dielectric insert relative to said shell.

2. The tool as recited in claim 1 and further comprising a handle attached to said second rod.

3. The tool as recited in claim 1 and further comprising a pad attached to said second rod, said pad being adapted to engage the dielectric insert.

4. The tool as recited in claim 1 and further comprising means for attaching said arms to said first rod, whereby said arms may be attached to said first rod at various positions therealong.

5. The tool as recited in claim 4 wherein said attaching means comprises:

at least two collars, each said arm having one of said collars mounted thereon, wherein said first rod is positioned within each said collar;

a plurality of set screws, at least one set screw being threadedly mounted through each said collar, said set screws being arranged to engage said first rod when tightened, such that said rod is held fast when said set screws are tightened and is slideably moveable through said collars when said set screws are loosened;

whereby said arms may be attached to said first rod at various positions therealong by loosening said set screws, slideably moving said rod through the collars, then retightening the set screws when a desired position is reached.

* * * * *